US006499405B1

(12) United States Patent
Ambrico

(10) Patent No.: US 6,499,405 B1
(45) Date of Patent: Dec. 31, 2002

(54) CONNECTION AND DELAY PYROTECHNIC DEVICE

(76) Inventor: Francesco Ambrico, Résidence le Clair Vallon, 38160 Saint Marcellin (FR)

( * ) Notice: Subject to any disclaimer, the term of this patent is extended or adjusted under 35 U.S.C. 154(b) by 0 days.

(21) Appl. No.: 09/644,092

(22) Filed: Aug. 23, 2000

(30) Foreign Application Priority Data

Aug. 24, 1999 (FR) ..... 99 10880

(51) Int. Cl.[7] ..... F42D 1/06; F42B 3/10; C06C 5/04

(52) U.S. Cl. ..... 102/275.7; 102/275.8; 102/277.1; 102/202.13

(58) Field of Search ..... 102/202.13, 202.14, 102/277.1, 360, 275.5, 275.7, 275.6, 275.11, 275.8, 275.71

(56) References Cited

U.S. PATENT DOCUMENTS

| | | | | |
|---|---|---|---|---|
| 2,548,946 A | | 4/1951 | Clauser et al. | |
| 3,169,480 A | * | 2/1965 | Seavey | 102/275.2 |
| 3,368,485 A | * | 2/1968 | Klotz | 102/275.2 |
| 3,460,477 A | * | 8/1969 | Heidemann et al. | 102/275.2 |
| 4,166,418 A | | 9/1979 | Calder, Jr. | |
| 4,423,682 A | * | 1/1984 | Schimmel | 102/275.2 |
| 4,809,610 A | * | 3/1989 | Florin | 102/275.2 |
| 4,953,464 A | * | 9/1990 | Reiss | 102/275.11 |
| 5,070,789 A | * | 12/1991 | True et al. | 102/275.7 |
| 5,086,702 A | * | 2/1992 | Jacob | 102/275.5 |
| 5,192,828 A | * | 3/1993 | Austin et al. | 102/275.7 |
| 5,322,018 A | * | 6/1994 | Hadden et al. | |
| 5,603,379 A | * | 2/1997 | Henke et al. | 102/275.7 |
| 5,631,440 A | * | 5/1997 | Thureson et al. | 102/275.2 |
| 6,227,116 B1 | * | 5/2001 | Dumenko | 102/275.6 |

FOREIGN PATENT DOCUMENTS

| | | |
|---|---|---|
| DE | 195 14 122 A1 | 11/1995 |
| FR | 353 200 | 9/1905 |

* cited by examiner

*Primary Examiner*—Michael J. Carone
*Assistant Examiner*—Lulit Semunegus
(74) *Attorney, Agent, or Firm*—Duane Morris LLP

(57) ABSTRACT

A pyrotechnic device of connection and delay between detonating cords and/or between an igniter and detonating cords, including a cavity divided up in two parts, the internal walls of which are coated with a very flammable material; a means for blocking one or several detonating cords in each of the parts; and a means for communicating between the two parts. The two parts are separated by a partition and the communication means includes a track containing a slowly and regularly burning material, extending outside the cavity walls between openings communicating with each of the two cavity parts.

14 Claims, 3 Drawing Sheets

CONNECTION AND DELAY PYROTECHNIC DEVICE

BACKGROUND OF THE INVENTION

1. Field of the Invention

The present invention relates to the field of pyrotechnics.

2. Discussion of the Related Art

When fireworks are desired to be set off, the number of ignitions of individual fireworks, such as rockets, light fountains, candles, etc. is desired to be minimized. Thus, the various fireworks, for example, rockets placed in mortars, are connected in clusters, that is, the fast detonating cord of each element is connected to another detonating cord directly or via a pyrotechnic delay element, itself connected to another detonating cord, to another delay element, etc. until a point is reached at which an electric igniter is connected. It would perhaps be simpler to directly connect each firework to a specific igniter and, by an electronic circuit, control the lighting time of each element. However, in practice, this appears to be much too expensive and it is preferred to use the traditional pyrotechnic detonating cord and delay system.

Delay devices are of various types. They may for example be slow detonating cords or Bickford fuses. However, more generally, delay devices formed of powder packed down in a cardboard cylinder are used, since they currently are the less expensive device. Currently, the connections between an igniter, detonating cords and delay devices are ensured by sheaths of brown wrapping paper and bindings, these sheaths and bindings being then possibly themselves bound or nailed on wooden bars, for example the case in which several mortars are arranged. The making of such an assembly is long and tedious. Thus, generally, the various elements are assembled in advance, in the workshop. Further, such assemblies are little accessible for a non-professional user.

The above delay devices also have the disadvantage of not enabling achieving any delay duration. It is generally admitted that, with current powders, the length of the cardboard cylinder determines the duration of the delay, which is on the order of one second per centimeter. In practice, it is difficult to obtain relatively precise delays of a duration shorter than 2 seconds or greater than 5 or 6 seconds. Otherwise, slow detonating cords of Bickford fuse type, which are much more expensive, must be used.

Further, brown wrapping paper assemblies are subject to malfunctions in case of heavy rain. The various delay devices and the various assemblies must then be protected.

Further, delay systems generate strong flames on one side of the cylinder when the delay element starts igniting and on both sides when the flame reaches the other end of the delay element. The strong flames are likely to set ablaze detonating cords or delay devices located near at hand. This imposes taking additional precautions and further complicates the assembly.

SUMMARY OF THE INVENTION

Thus, an object of the present invention is to provide a system of connection and delay between detonating cords or between an igniter and detonating cord(s) which is particularly simple to implement and which enables achieving delays of chosen durations, for example from a null duration to durations on the order of one minute or more.

Another object of the present invention is to provide such a system enabling selection of a delay of a duration selected from among several predetermined durations.

To achieve these objects, the present invention provides a pyrotechnic device of connection and delay between detonating cords and/or between an igniter and detonating cords, including a cavity divided up in two parts, the internal walls of which are coated with a very flammable material; a means for blocking one or several detonating cords in each of the parts; and a means for communicating between the two parts.

According to an embodiment of the present invention, the two parts are separated by a partition and the communication means includes a track, containing a slowly and regularly burning material, extending outside the cavity walls between openings communicating with each of the two cavity parts.

According to an embodiment of the present invention, the device includes a first hollow cylinder, the internal cavity of which is divided up in two parts by a partition, and the external wall of which includes a track which communicates through openings with said parts; and a second hollow cylinder, the internal diameter of which corresponds to the external diameter of the first hollow cylinder and in which the first cylinder is inserted.

According to an embodiment of the present invention, the device includes a hollow internal cylinder, the internal cavity of which is divided up in two parts by a partition and the external wall of which includes apertures; and a hollow intermediary cylinder likely to be assembled coaxially and rotatably outside of the internal cylinder, the external wall of the intermediary cylinder including tracks, the ends of which communicate through openings with the apertures of the internal cylinder, when the cylinders are properly oriented in rotation.

According to an embodiment of the present invention, said track(s) are filled with a packed down flammable powder.

According to an embodiment of the present invention, the blocking means includes strips made of a flexible but relatively sturdy material, extending substantially perpendicularly to detonating cord insertion apertures, and likely to deform towards the inside upon insertion of a detonating cord, to block an extraction of the detonating cord.

The foregoing objects, features and advantages of the present invention, will be discussed in detail in the following non-limiting description of specific embodiments in connection with the accompanying drawings.

DETAILED DESCRIPTION

Figure 1A:
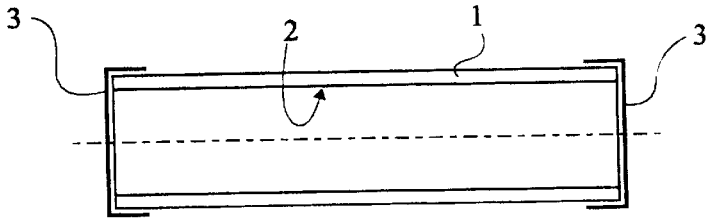
FIG. 1A is a cross-section view of a first embodiment of the present invention.

FIG. 1A is a cross-section view of a first embodiment of the present invention formed of a hollow cylinder 1, the internal walls 2 of which are coated with a very flammable material, preferably a pulverulent product very easily igniting within a cavity. This product is for example glued black powder.

At each end of cylinder 1 is mounted a detonating cord holding means 3. In the embodiment of FIG. 1A, this holding means is shown in the form of a cap. Preferably, cylinder 1 and caps 3 are made of plastic.

Figure 1B:
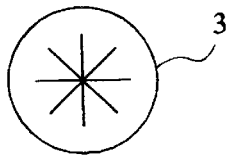
FIG. 1B is an end view of an example of a cap of the device of FIG. 1A.

FIG. 1B shows an end view of an example of a cap. The planar portion of the cap is for example a thin resilient plastic sheet cut-up in a star to form strips, the tip of which is substantially at the intersecting point of the sheet and of the cylinder axis. Thus, when a detonating cord is driven in towards the inside of the cylinder, the elementary strips deform and curve up towards the inside, preventing a retrieval of the detonating cord.

Figure 1C:
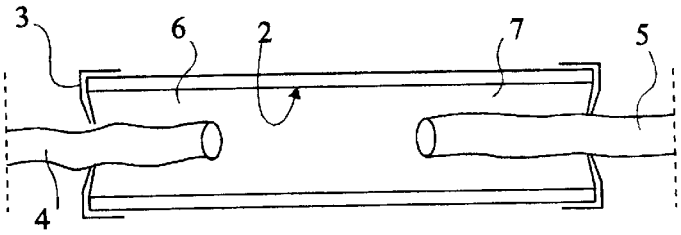
FIG. 1C shows the device of FIG. 1A in which detonating cords are inserted.

FIG. 1C shows the device of FIG. 1A, also in a cross-section view, in the case where detonating cords 4 and 5 are respectively inserted in the left-hand part 6 and in the right-hand part 7 of the cylinder. The detonating cords can be more or less driven in and join or not. The strips of caps 3 have been shown as deformed towards the inside and it can be well understood that this prevents a pulling out of the detonating cords, even by exerting a reasonable force. Of course, it will always be possible, by using a releasing tool or by pulling sufficiently hard, to pull cut the detonating cords if necessary.

Figure 1D:
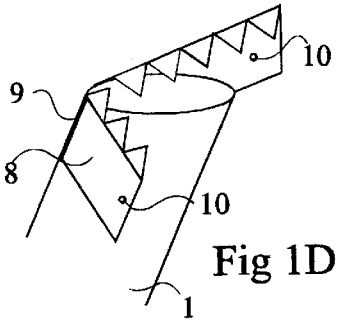
FIG. 1D is a perspective view showing an alternative of a blocking cap according to the present invention.

FIG. 1D illustrates an alternative embodiment of detonating cord holding means 3 according to the present invention. This means takes the form of a collar 8 provided with teeth directed towards the inside and attached at a point 9 to one end of tube 1. The free ends of the collar are provided with additional attachment means 10, for example by snapping, for fastening the collar against a detonating cord and the tube walls. This embodiment enables better adaptation to relatively hard detonating cords of large diameter.

The device according to the first embodiment of the present invention enables connection between two detonating cords. For example, once detonating cord 4 has been ignited, it transmits flames to the inside of the cylinder, which can directly ignite the end of the opposite detonating cord 5. Further, detonating cord 4 causes the very fast lighting of the powder arranged on internal walls 2 and the flame created by this powder causes the lighting of second detonating cord 5 if no direct ignition has occurred.

It should be noted that cylinders 1 and their caps 3 may be sized so that one or several detonating cords can be introduced at each end. A detonating cord may also be introduced on one side while an electric igniter is introduced on the other side, or else a detonating cord and an igniter may be introduced on one side and one or several detonating cords may be introduced on the other side to propagate the flame communicated by the igniter simultaneously to several detonating cords.

Figure 2:
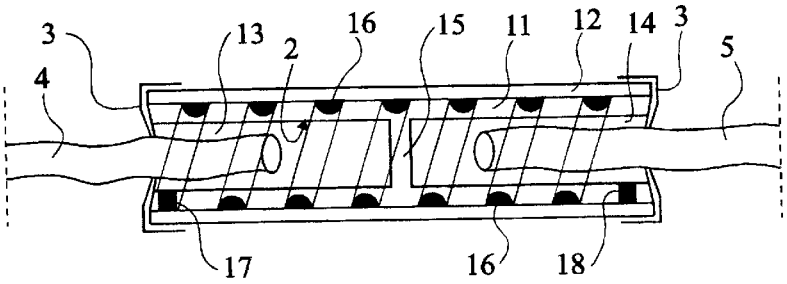
FIG. 2 is a simplified cross-section view of a second embodiment of the present invention.

FIG. 2 shows a cross-section view of a second embodiment of the present invention ensuring a function of connection between detonating cords with a non-zero delay. The device according to the second embodiment of the present invention includes two cylindrical components 11 and 12 fit into each other. The internal cavity of internal cylinder 11 is divided up in two parts 13 and 14 by a partition 15. The internal walls of each of parts 13 and 14 are, as in the case of the first embodiment of the present invention, coated with a very flammable material 2. The external wall of internal cylinder 11 is provided with a grooved surface, for example helical, analogous to a threading, forming a track 16 which communicates by a first end with an opening 17 in the wall of left-hand part 13 of the internal cavity of cylinder 11 and by a second end with an opening 18 in the wall of left-hand part 14 of the internal cavity of cylinder 11. Track 16 formed between openings 17 and 18 is filled with a material enabling, when ignited at one end, propagating the flame to the other end, at a substantially constant linear speed. It will for example be packed down black powder or a specific cord such as a thin slow detonating cord manufactured by Bickford company.

As in the case of the first embodiment, end caps 3 enable insertion and blocking of detonating cords 4 and 5 in each of cavity parts 13 and 14. Thus, when detonating cord 4, or an igniter replacing detonating cord 4, causes the creation of a flame in left-hand part 13, this flame lights the powder arranged on the walls of part 13. The flame propagates in powder arranged in opening 17 and along track 16, reaches opening 18, ignites the powder arranged on the walls of right-hand part 14 of the cavity, and triggers off the lighting of detonating cord 5.

The device illustrated in FIG. 2 has many advantages as compared to a conventional pyrotechnic delay element:

- simplicity of use: it enables easy insertion of detonating cords 4 and 5; several delay elements may simply be assembled in series;
- reliability: it is practically insensitive to humidity or to a heavy rain;
- extended setting range: the delay durations can be chosen in a very wide range of values; delays up to or over one minute can be achieved by choosing an extremely tight pitch of track 15;
- safety: since the ignition propagates from one end to the other of the device along a track protected by external cylinder 17, there is no flame jet to the outside and the device does not risk igniting neighboring devices nor burning an operator;
- multiple delays: as will be seen hereafter, a device according to the present invention can enable selecting a delay from a among several predetermined delays.

Figure 3:
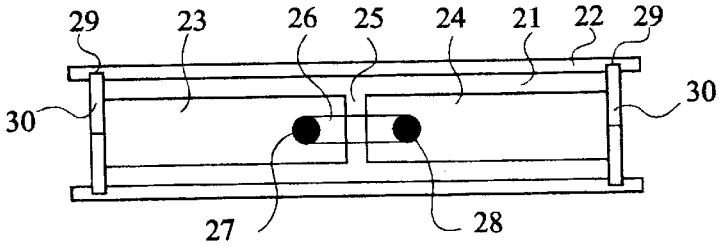
FIG. 3 is a simplified cross-section view of a third embodiment of the present invention.

FIG. 3 shows an alternative embodiment of the device of FIG. 2, forming a third embodiment of the present invention. In FIG. 3, the device includes an internal cylinder 21 and an external cylinder 22. The internal cavity is divided up in two parts 23 and 24 by a partition 25. A short rectilinear track 26 extends between openings 27 and 28 crossing the walls of cavity parts 23 and 24.

In the embodiment of FIG. 3, if the delay between the left-hand part and the right-hand part of cylinder 21 is desired to be further shortened, partition 25 can be opened. A structure very similar to that of the first embodiment of the present invention is then obtained.

A detonating cord holding/blocking system different from that of FIGS. 1 and 2 is also illustrated in FIG. 3. This alternative could be used in the other embodiments of the present invention. As shown in FIG. 3, external tube 22 extends on either side beyond internal tube 21 and includes in the excess portion an annular groove 29 for receiving a detonating cord-blocking disk 30. This disk may have in end view a shape similar to that of FIGS. 1 and 2. It may also be chosen for the device of FIG. 3 to have larger slits between elementary strips and for the central portion to be cut up. A disk made of flexible metal may also be chosen. According to another alternative of the present invention, not shown, the holding system may be formed of molded plastic strips forming one piece with the ends of the internal cylinder.

Figure 4:
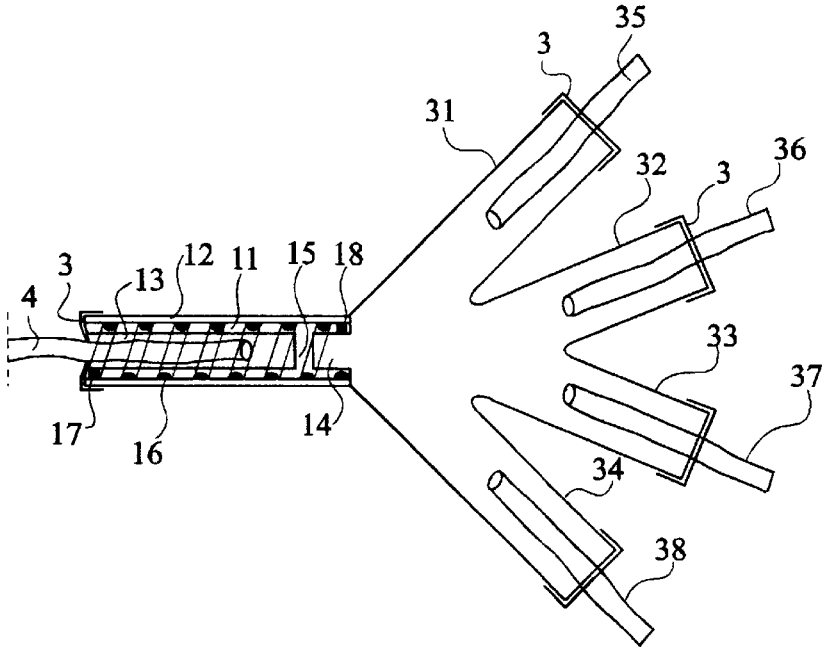
FIG. 4 is a simplified cross-section view, partially in cross-section, of a fourth embodiment of the present invention.

FIG. 4 shows a fourth embodiment of the present invention. The left-hand portion of the drawing includes a device similar to that of FIG. 2 in which same elements have been designated by same references. Right-hand part 14 of the cavity located to the right of partition 15 extends by dividing up in several cylinders 31 to 34, each of which is intended for receiving a detonating cord 35 to 38.

Figure 5A:
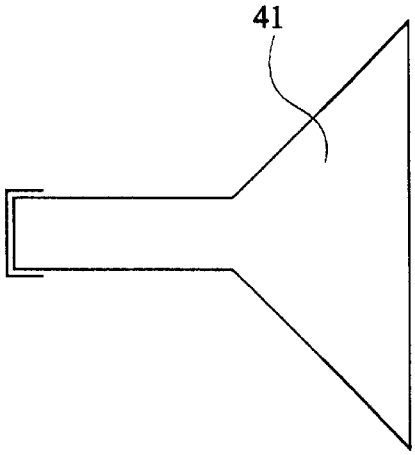
FIG. 5A is a side view of a fifth embodiment of the present invention.
Figure 5B:
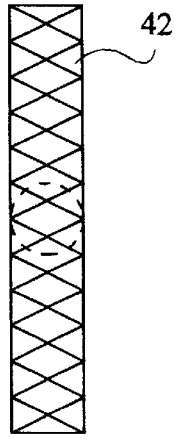
FIG. 5B is an end view of the fifth embodiment of the present invention.

FIGS. 5A and 5B show in side view and in front view a fifth embodiment of the present invention. The left-hand part of the device of FIG. 5A is similar to that of FIG. 4. On the right-hand side of the drawing, the device, instead of dividing up in several cylinders, opens out in a fan 41, its end surface including a system 42 for blocking against any retrieval several detonating cords that can be inserted in parallel.

Thus, the present invention provides a particularly simple, reliable, adjustable and safe delay device. Further, this device can be of relatively low cost, it can be manufactured in large quantities in plastic.

Figure 6:
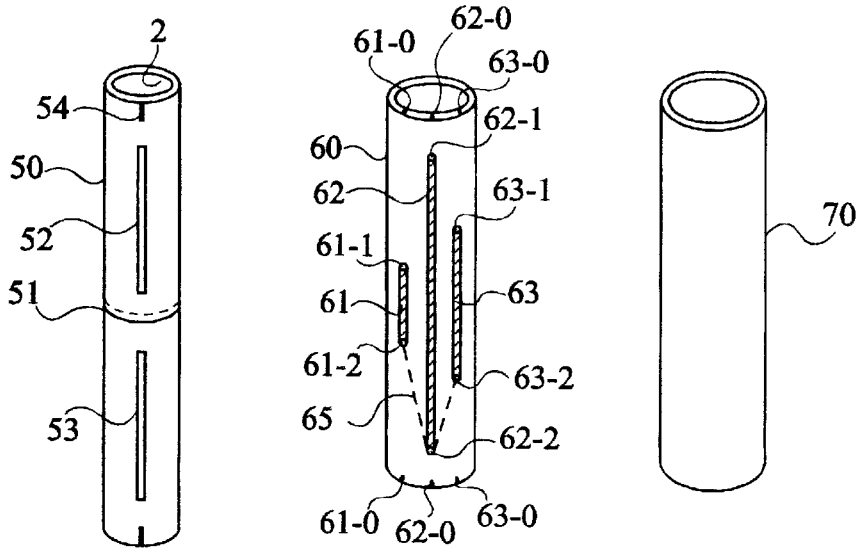
FIG. 6 is a side view of three tubes forming a sixth embodiment of the present invention.

FIG. 6 shows a sixth embodiment of the present invention in which a same pyrotechnic delay device can, at the user's choosing, achieve one of several determined delays.

This device includes an internal tube 50, an intermediary tube 60 and an external tube 70.

Internal tube 50, like tube 1 of FIG. 1, tube 11 of FIG. 2, or tube 21 of FIG. 3, has its internal walls coated with a very flammable material 2. Tube 50 is divided up in two parts by an internal partition 51. It includes through openings 52 and 53 on either side of the partition.

Intermediary tube 60 is a tube on the external surface of which are formed several tracks 61, 62, 63, which are longitudinal in the shown example, and the ends of which include openings 61-1, 61-2, 62-1, 62-2, and 63-1, 63-2. These openings cross tube 60.

Finally, the device includes an external protection tube 70.

External tube 70 is mounted as attached to intermediary tube 60 which can rotate with respect to internal tube 50. Various means may be provided so that, after assembly, the internal tube can rotate with respect to the intermediary tube which being axially held.

When slots 52, 53, for example, face openings 61-1, 61-2, if a detonating cord is ignited on the side of opening 61-1, the lighting is transmitted with a determined delay along track 61 towards opening 61-2. By rotating the internal tube with respect to the intermediary tube, one of delay elements 62 or 63 or another delay element not shown arranged on the non-visible part of the intermediary cylinder can be selected.

A first mark 54 is formed on the external edge of the internal tube, which is for example slightly longer than the intermediary tube, to facilitate its grasping and its rotating. The intermediary tube is provided with second marks, preferably at its two ends, respectively 61-0, 62-0, and 63-0. The duration of the corresponding delay can be indicated in front of these marks by any means. The delay durations may for example be written, or various color codes may be used.

According to an alternative of the present invention, illustrated in FIG. 6, a track 65 extends between the ends of tracks 61, 62, 63, on the side opposite to the side where the ignition normally occurs. Thus, once a track has been ignited and has performed its delay effect, the ignition propagates to the other tracks and the powder contained therein is burnt, which avoids for the device, once used, to present any danger.

Figure 7:
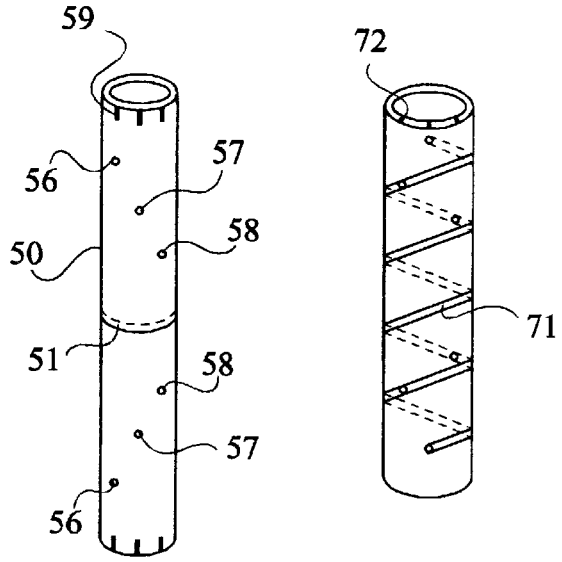
FIG. 7 is a side view of two tubes forming an alternative of the sixth embodiment of the present invention.

FIG. 7 shows an alternative of the sixth embodiment of the present invention. Instead of providing in internal tube 50 grooves 52, 53 on either side of partition 51, coupled openings 56, 57, 58 intended for cooperating with corresponding openings of the intermediary tube are provided. The openings of the intermediary tube may be those shown in FIG. 6. They may also be the openings of a helical track 71 shown in FIG. 7. In this embodiment, a number of identical marks 59 on the internal tube side and 72 on the external tube side will have to be provided. The marks will have to be identified. Preferably, they will be identified by same colors or same indications.

As an alternative, in the context of FIG. 7, no external protection tube has been shown. Indeed, this tube could be replaced with a varnish or a dipping of the intermediary cylinder component in a plastic substance likely to polymerize.

This sixth embodiment of the present invention may appear to be more complex than the previously-described embodiments. However, the manufacturing cost of such a device will be lower than the others since it can be manufactured in very large series, a same device being useable to achieve different delays. Further, the problem of having to store ranges of delay devices will no longer be posed to the user.

Of course, the present invention is likely to have various alterations, modifications, and improvements which will readily occur to those skilled in the art. In particular, in same cases, several tracks may be provided on a same device, one or the other of which may be filled with a flammable material, so that, with a same plastic piece, several delays can be achieved. Further, the various described embodiments can be combined; for example, the multiple-link systems of FIGS. 4 and 5 may be adapted to the first embodiment of the present invention.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A pyrotechnic device of connection and delay between detonating cords and/or between an igniter and detonating cords, including:

a cavity divided up in two parts separated by a partition, the internal walls of said cavity being coated with a flammable material;

means for blocking one or several detonating cords in each of the parts; and means for communicating between the two parts, including a track, containing a slowly and regularly burning material, extending outside the cavity walls between openings communicating with each of the two cavity parts.

2. The pyrotechnic device of claim 1, including:

a first hollow cylinder, the internal cavity of which is divided up in two parts by a partition, and the external wall of which includes a track which communicates through openings with said parts; and a second hollow cylinder, the internal diameter of which corresponds to the external diameter of the first hollow cylinder and in which the first cylinder is inserted.

3. The pyrotechnic device of claim 1, including:

a hollow internal cylinder, the internal cavity of which is divided up in two parts by a partition and the external wall of which includes apertures; and a hollow intermediary cylinder likely to be assembled coaxially and rotatably outside of the internal cylinder, the external wall of the intermediary cylinder including tracks, the ends of which communicate through openings with the apertures of the internal cylinder, when the cylinders are properly oriented in rotation.

4. The pyrotechnic device of claim 2, wherein said track extends helically.

5. The pyrotechnic device of claim 2, wherein said track extends rectilinearly.

6. The pyrotechnic device of claim 2, wherein said track is filled with a packed-down flammable powder.

7. The pyrotechnic device of claim 2, wherein, on one side, the first cylinder divides up in several tubes.

8. The pyrotechnic device of claim 2, wherein, on one side, the first cylinder opens cut in a fan.

9. The pyrotechnic device of claim 1, wherein the blocking means includes strips made of a flexible but relatively sturdy material, extending substantially perpendicularly to detonating cord insertion apertures, and likely to deform towards the inside upon insertion of a detonating cord, to block an extraction of the detonating cord.

10. The pyrotechnic device of claim 3, wherein said tracks extend helically.

11. The pyrotechnic device of claim 3, wherein said tracks extend rectilinearly.

12. The pyrotechnic device of claim 3, wherein said tracks are filled with a packed-down flammable powder.

13. The pyrotechnic device of claim 2, wherein the blocking means includes strips made of a flexible but relatively sturdy material, extending substantially perpendicularly to detonating cord insertion apertures, and likely to deform towards the inside upon insertion of a detonating cord, to block an extraction of the detonating cord.

14. The pyrotechnic device of claim 3, wherein the blocking means includes strips made of a flexible but relatively sturdy material, extending substantially perpendicularly to detonating cord insertion apertures, and likely to deform towards the inside upon insertion of a detonating cord, to block an extraction of the detonating cord.

* * * * *